US005360354A

United States Patent [19]

Czyperreck et al.

[11] Patent Number: 5,360,354

[45] Date of Patent: Nov. 1, 1994

[54] CONTACT PIN WITH CERAMIC INSULATION

[75] Inventors: Hans Czyperreck; Fritz Meiler, both of Lauf; Helmut Stuhler, Nürnberg, all of Germany

[73] Assignee: Hoechst CeramTec Aktiengesellschaft, Selb, Germany

[21] Appl. No.: 30,026

[22] PCT Filed: Sep. 25, 1991

[86] PCT No.: PCT/EP91/01827

§ 371 Date: Mar. 25, 1993

§ 102(e) Date: Mar. 25, 1993

[87] PCT Pub. No.: WO92/05605

PCT Pub. Date: Apr. 2, 1992

[30] Foreign Application Priority Data

Sep. 26, 1990 [DE] Germany ..... 4030408

[51] Int. Cl.[5] ..... H01R 13/415

[52] U.S. Cl. ..... 439/741

[58] Field of Search ..... 439/741

[56] References Cited

FOREIGN PATENT DOCUMENTS 2093632 9/1982 United Kingdom .

*Primary Examiner*—Eugene F. Desmond

*Attorney, Agent, or Firm*—Foley & Lardner

[57] ABSTRACT

In the contact pin with ceramic insulation, one end is provided with a tongue for receiving a pole shoe and the other end is provided with a step which rests against a corresponding step in the flat channel running through the ceramic insulation. The first step of the contact pin is followed by a second step which projects slightly out of the channel and is provided with an upsetting.

6 Claims, 2 Drawing Sheets

CONTACT PIN WITH CERAMIC INSULATION

The subject of the invention is a contact pin with ceramic insulation which is provided at one end with a tongue for receiving a pole shoe and at the other end has a step which rests against a corresponding step in the flat channel running through the ceramic insulation.

Contact pins of the type mentioned are known. They are used as current supply for electric lamps, in particular for halogen lamps. A disadvantage of the known contact pins is that the connection of the current-carrying conductor to the ceramic insulation is not free of looseness, and this leads to vibrations of the incandescent coil and consequently adversely affects its service life. In the case of contact pins spray-coated with plastic, although the metal/insulation connection is free of looseness, at elevated temperatures to which the contact pins are exposed, volatile substances are given out as gas and these deposit on the reflector of the lamp. At sufficiently high temperatures, the insulation loses its shape.

It is here that the invention seeks to provide a remedy. The invention achieves the object by the fact that the first step is followed by a second step which projects slightly out of the channel and is provided with an upsetting.

The second step may have an undercut. Instead of the second step on the contact pin, the ceramic insulation may be provided with recesses which cut the flat channel laterally and the contact pin may have upsettings in the region of said recesses.

The advantages achieved by the invention are essentially to be perceived in the looseness-free, positive connection between metallic contact pin and ceramic insulation.

The invention is explained below in greater detail with reference to the drawings, which show exemplary embodiments. In these:

Figure 1:
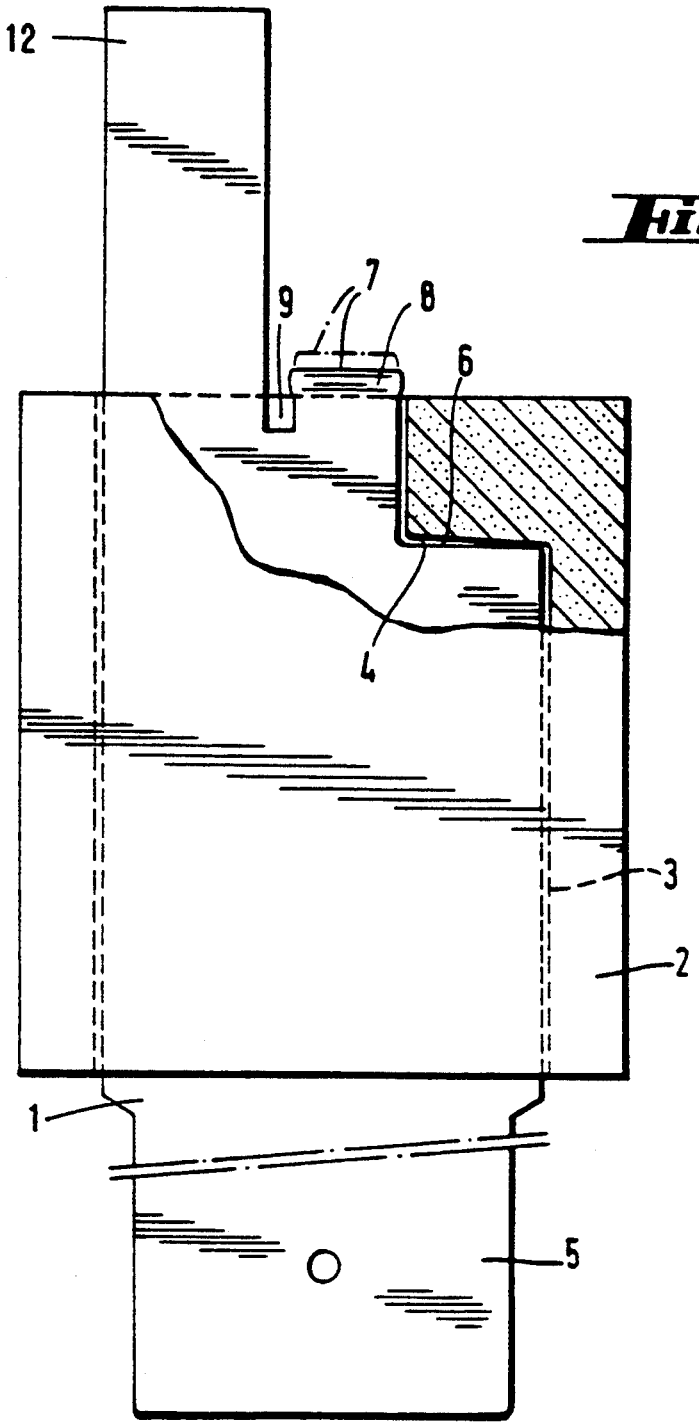
FIG. 1 shows a view of the contact pin with ceramic insulation, partially sectioned.
Figure 2:
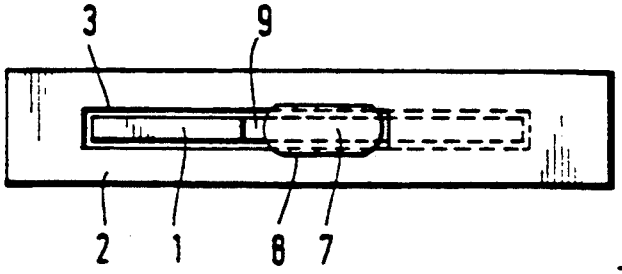
FIG. 2 shows the plan view of FIG. 1.
Figure 3:
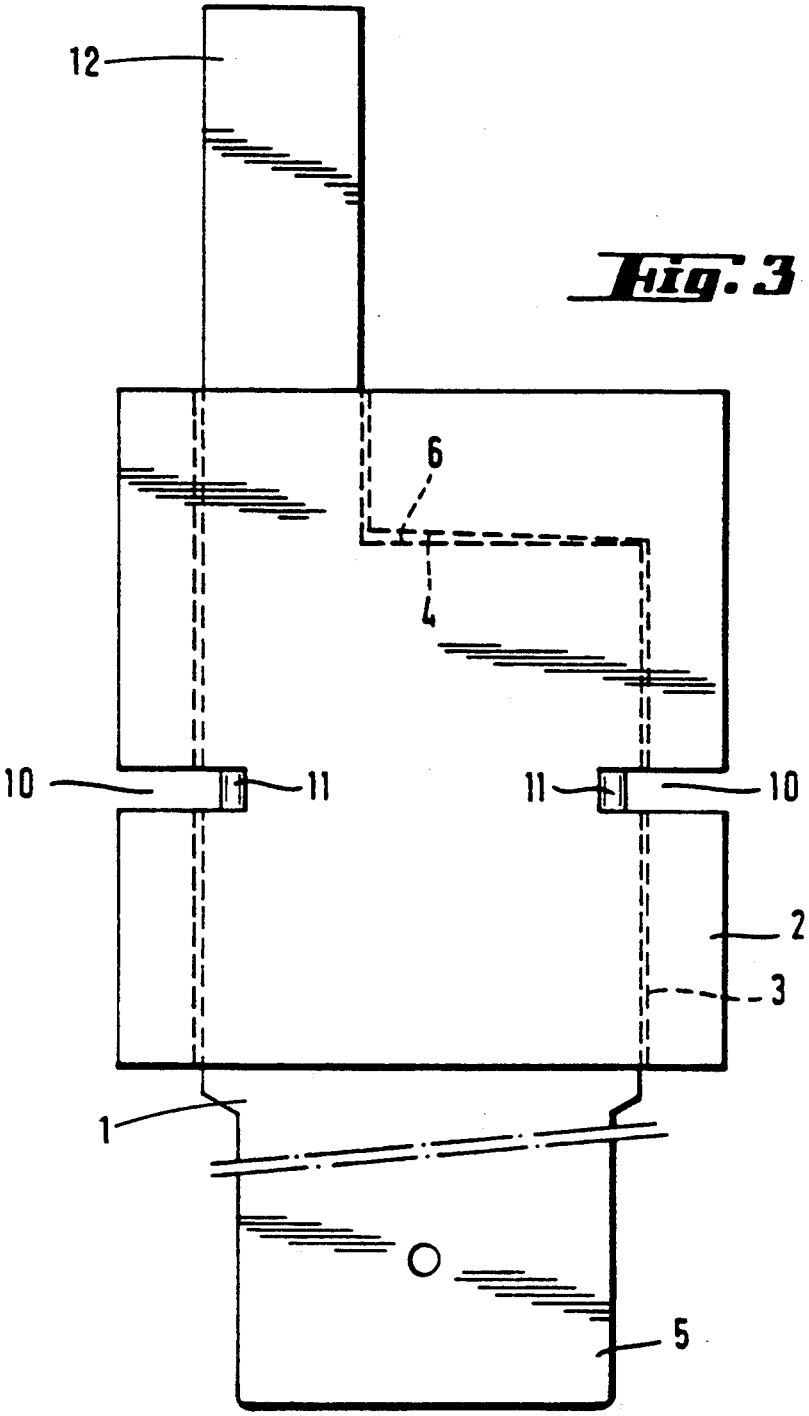
FIG. 3 shows a view of the contact pin with ceramic insulation in an alternative embodiment and FIG. 4 shows the plan view of FIG. 3.
Figure 4:
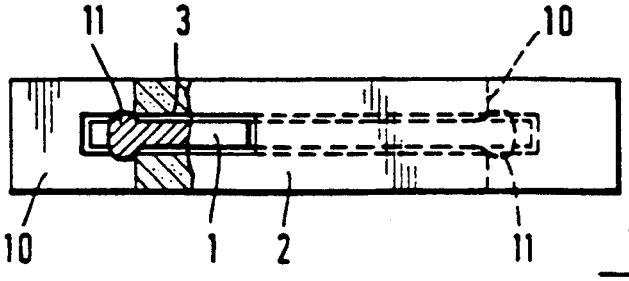

The contact pin 1, which is composed of electrically conducting material such as steel, copper, tungsten and the like, is provided with a ceramic insulation 2. The ceramic insulation 2 has a flat channel 3 which is provided with a step 4. The contact pin 1 is provided with a flap 12 a tongue 5 for receiving a pole shoe and with at least one step 6 which rests against the step 4 of the flat channel 3. In the embodiment according to FIGS. 1 and 2, the contact pin has a further step 7 which vertically projects slightly (1 –3 mm) out of the flat channel 3. Said step 7 is provided with an upsetting 8 on the top horizontal surface of the step 7, which can extend over the entire perimeter of the step 7 The upsetting 8 in conjunction with step 6, connects the contact pin 1 positively and looseness-freely to the ceramic insulation 2. It may be of advantage to provide the step 7 with an undercut 9. In the embodiment according to FIGS. 3 and 4, instead of the second step on the contact pin 1, the ceramic insulation 2 is provided with recesses 10 which cut the flat channel 3 laterally. In the region of the recesses 10, the contact pin has upsettings 11. The upsettings 8, 11 on the contact pin can be produced in a manner known per se. Hot upsetting has been found to be particularly advantageous. For this purpose, the contact pin is brought electrically to hot forming temperature.

We claim:

1. A contact pin with ceramic insulation which is provided at one end with a tongue for receiving a pole shoe and at the other end has a step which rests against a corresponding step in a flat channel running through the ceramic insulation, wherein the first step is followed by a second step which vertically projects slightly out of the channel and is provided with an upsetting on the top horizontal surface of said second step.

2. The contact pin as claimed in claim 1, wherein the second step (7) has an undercut (9) .

3. A contact pin with ceramic insulation which is provided at one end with a tongue for receiving a pole shoe and at the other end has a step which rests against a corresponding step in a flat channel running through the ceramic insulation, wherein the ceramic insulation (2) is provided with recesses (10) which cut the flat channel (3) laterally and the contact pin (1) has upsettings (11) in the region of said recesses (10).

4. A contact pin with ceramic insulation which is provided at one end with a tongue for receiving a pole shoe and has another end which comprises a flap which extends out of the ceramic insulation, a first step which rests against a corresponding step in a flat channel running through the ceramic insulation, and a second step which lies between said flap and said first step and which projects slightly out of the channel in a vertical direction, and is provided with an upsetting.

5. The contact pin as claimed in claim 4, wherein the upsetting extends over the entire perimeter of the second step.

6. The contact pin as claimed in claim 4, further comprising a vertically extending undercut which lies between said flap and said second step.

* * * * *